United States Patent [19]

Mikuni et al.

[11] Patent Number: 4,817,545

[45] Date of Patent: Apr. 4, 1989

[54] THREAD TAKE-UP LEVER DEVICE FOR SEWING MACHINES

[75] Inventors: Yoshio Mikuni, Osaka; Osamu Tanaka, Hirakata, both of Japan

[73] Assignee: Maruzen Sewing Machine Co., Ltd., Moriguchi, Japan

[21] Appl. No.: 64,393

[22] Filed: Jun. 22, 1987

[30] Foreign Application Priority Data

Jun. 23, 1986 [JP] Japan ..... 61-96375[U]
Jul. 30, 1986 [JP] Japan ..... 61-180870

[51] Int. Cl.[4] ..... D05B 40/02
[52] U.S. Cl. ..... 112/241
[58] Field of Search ..... 112/57, 96, 241, 245, 112/246, 247

[56] References Cited

U.S. PATENT DOCUMENTS

| | | | |
|---|---|---|---|
| 276,113 | 4/1983 | Willcox et al. | 112/241 |
| 1,129,588 | 2/1915 | Onderdonk | 112/241 |
| 3,545,392 | 12/1970 | Fresard | 112/241 |
| 4,030,431 | 6/1977 | Martin et al. | 112/241 |
| 4,413,578 | 11/1983 | Rodda | 112/254 |
| 4,520,743 | 6/1985 | Zylbert | 112/245 X |
| 4,688,501 | 8/1987 | Mikuni et al. | 112/241 |

FOREIGN PATENT DOCUMENTS

| | | | |
|---|---|---|---|
| 61-206480 | 9/1986 | Japan | 112/241 |
| 325806 | 11/1957 | Switzerland | 112/241 |

*Primary Examiner*—Wm. Carter Reynolds
*Attorney, Agent, or Firm*—Lowe, Price, LeBlanc, Becker & Shur

[57] ABSTRACT

An upper thread is guided to extend vertically by a pair of thread guides vertically opposted to each other. A thread take-up lever is installed so that it is horizontally reciprocated across the space between the pair of thread guides. When the thread take-up lever is reciprocated, it engages the thread positioned between the thread guides to draw it in V-form during its forward travel and stops drawing the thread to form a slack in the thread in its return travel. To prevent this slacked thread portion from clinging to the thread take-up lever, a thread holding member or thread braking member made of easily deformable material and adapted to contact the thread to thereby prevent the thread from following the movement of the thread is installed at at least one position along the path of travel of the thread engaging portion (10, 10*a*, 10*b*, 10*c* 50) of the thread take-up lever.

6 Claims, 10 Drawing Sheets

THREAD TAKE-UP LEVER DEVICE FOR SEWING MACHINES

BACKGROUND OF THE INVENTION

1. Field of the Invention

This invention relates to a thread take-up lever device for sewing machines and particularly to improvements for enhancing the performance of the thread take-up lever itself included in a thread take-up lever device.

2. Description of the Prior Art

In the most common sewing machine, the tread take-up lever has an eyelet. And an upper thread is passed through said eyelet. In operative association With an upper shaft or main shaft housed in a sewing machine frame and driven for rotation, the thread take-up lever is vertically reciprocated and in accordance with this reciprocating motion it tightens or loosens the thread by the amount necessary for forming a stitch.

It is usual for the thread take-up lever to be reciprocated in a vertically extending slit formed in the frame. In the sewing machine of the type described above, to make possible an operation for passing a thread through the eyelet of the thread take-up lever, a state in which the eyelet comes out of the frame must be created over at least a portion of the range of reciprocating motion of the thread take-up lever. For this reason, it has been impossible to house the thread take-up lever completely in the frame.

On the other hand, an eyeletless thread take-up lever is disclosed in U.S. Pat. No. 3,782,312 granted to Kasuga on Jan. 1, 1974. According to this patent, the thread take-up lever is formed with a hook portion adapted to engage the thread when drawing the latter. Thus, the operation for passing the thread through an eyelet becomes unnecessary and hence the thread take-up lever can be completely housed without being exposed outside the frame.

A thread take-up lever functions to tighten or loosen the thread in accordance with its reciprocating motion. In this connection, it is to be noted that because of its tightening action on the thread, the thread take-up lever often causes thread breaks. On such occasions, the thread suddenly loosens and clings to the thread take-up lever and in extreme cases it coils itself around the thread take-up lever in cooperation with the movement of the thread take-up lever. In the case where the thread clings to or coils itself around the thread take-up lever, it is very difficult to undo this condition, and particularly in a sewing machine of the type in which the thread take-up lever is housed completely in the frame, it is not an easy job to undo the clinging or coiling of the thread to or around the thread take-up lever.

Further, the occasion of the thread clinging to or coiling around the thread take-up lever is not limited to the time when a thread break takes place. Such clinging to the thread take-up lever may occur very often depending upon the kind of the thread even during normal operation of the sewing machine. For example, in the case of a fluffy thread or a hard-twist thread, such clinging phenomena would be noticeable.

SUMMARY OF THE INVENTION

Accordingly, an object of this invention is to provide a thread take-up lever device for sewing machines . which is capable of preventing a thread from clinging to the thread take-up lever.

A thread take-up lever device according to the invention comprises thread take-up lever means having a portion for engagement with a thread and adapted to be reciprocated in such a manner that said engaging portion is reciprocated along a predetermined path to draw the thread during the return travel; and means for preventing the thread from clinging to said thread take-up lever means, fixedly installed at at least one position located along said path of travel of said engaging portion, so that by contacting a portion of the thread, said means prevents said portion of the thread from following said thread take-up lever.

According to the invention, the cling preventive means is in a fixed position while contacting a portion of the thread, while the thread take-up lever means is reciprocating. Therefore, even if a thread break occurs, the thread does not follow the return travel of the thread take-up lever means because of the presence of the cling preventive means; thus, it is separated from the thread take-up lever means as a result of the return travel of the thread take-up lever means. Further, in the case of a thread which tends to cling to the thread take-up lever means and will not break, a slack in the thread which forms during the return travel of the thread take-up lever means tends to be separated from the thread take-up lever means because of its contact with the cling preventive means. Therefore, the clinging of the thread to the thread take-up lever means is advantageously prevented. If the clinging of the thread to the thread take-up lever means is so prevented, it is also possible to eliminate the problem of the thread coiling itself around the thread take-up lever means as the clinging of the thread to the thread take-up lever means becomes more serious.

The cling preventive means which characterizes the invention is classified into two types of embodiments on the basis of its action on the thread. In a first type of embodiment, the cling preventive means has a contact section which acts in such a manner that in at least one position in the path of travel of the engaging portion of the thread take-up lever means, it contacts the thread take-up lever means and holds the thread engage by the engaging portion of the thread take-up lever means while imparting friction to the thread. In a second type of embodiment, the cling preventive means has thread braking means which is disposed to extend across the path of travel of the engaging portion of the thread take-up lever means, said thread braking means being designed so that while engaging a portion of the thread engaged by the engaging portion it relatively acts in the direction in which a slack in the thread produced during the return travel of the engaging portion is released from the thread take-up lever means as a result of the return travel of the thread take-up lever means.

BRIEF DESCRIPTION OF THE INVENTION

FIG. 1 is a perspective view of a portion of a sewing machine having an embodiment of the invention applied thereto;

FIG. 2 is a top view showing a thread take-up lever 9 and an arrangement related thereto, said thread take-up lever being provided with an engaging portion 10 adapted to be reciprocated within a thread guide member 4 shown in FIG. 1;

FIGS. 3A through 3F diagrammatically illustrate the operations of the thread take-up lever 9, a needle 8 and a shuttle hook 19 when the engaging portion 10 is positioned at positions A through F shown in FIG. 2;

FIGS. 4 through 8 sequentially diagrammatically show the process of a phenomenon of a thread 6 coiling itself around the thread take-up lever 9 which takes place on the occurrence of a thread break;

FIGS. 9D and 9E show states corresponding to the operating phases shown in FIGS. 3D and 3E, respectively, illustrating a phenomenon of the thread 6 clinging to the thread take-up lever 9 which takes place in the case where the twist imparted to the thread is hard;

FIGS. 10D and 10E sequentially illustrate the process of the thread 6 clinging to the thread take-up lever 9 in the case where a thread take-up lever 9*a* does not release the thread 6 even during its return travel, the states shown in FIGS. 10D and 10E corresponding to the states shown in FIGS. 3D and 3E, respectively;

Figure 17:
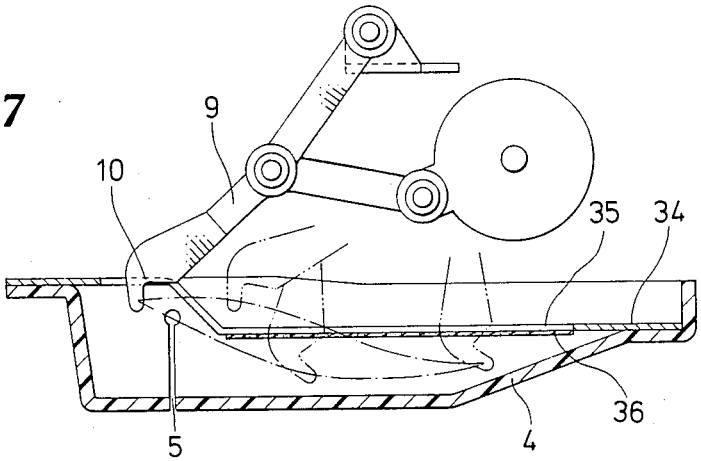
FIG. 17 is a top view of the principal portion of a sewing machine having still another embodiment of the invention, the thread guide member 4 being shown in section.
Figure 18:
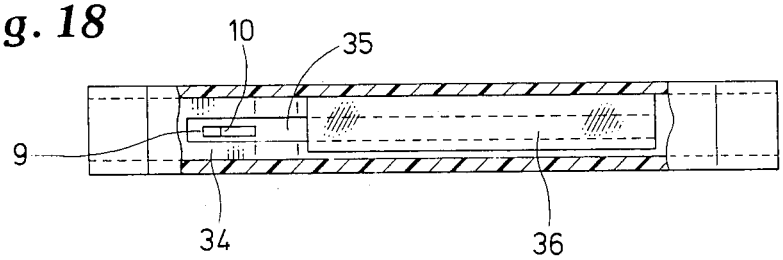
FIG. 18 is a front view, partly broken away, of the thread guide member 4 shown in FIG. 17.
Figure 19:
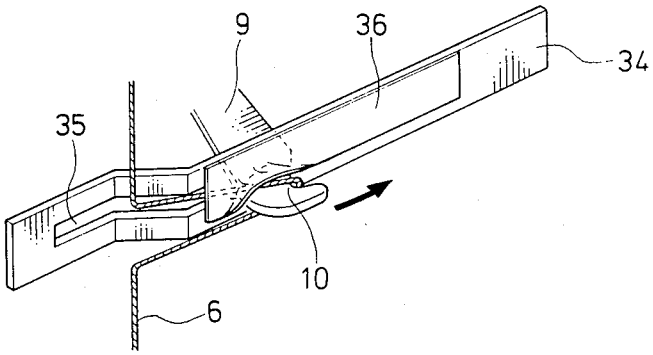
Figure 20:
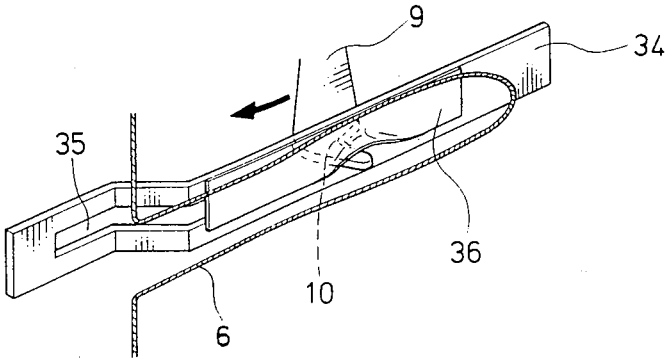
Figure 21:
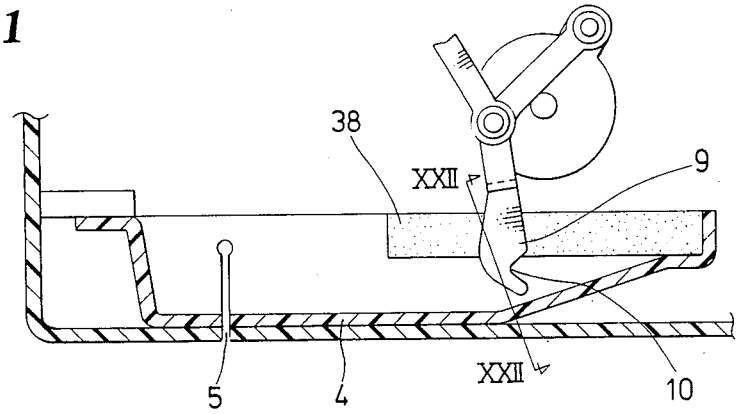
Figure 22:
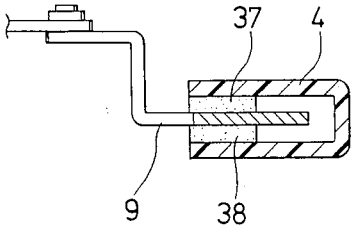
Figure 23:
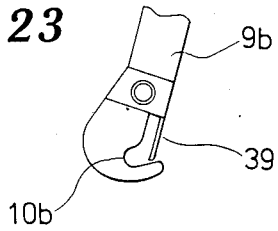
Figure 24:
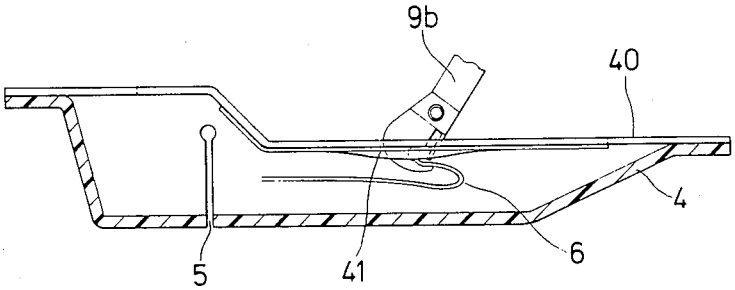
Figure 25:
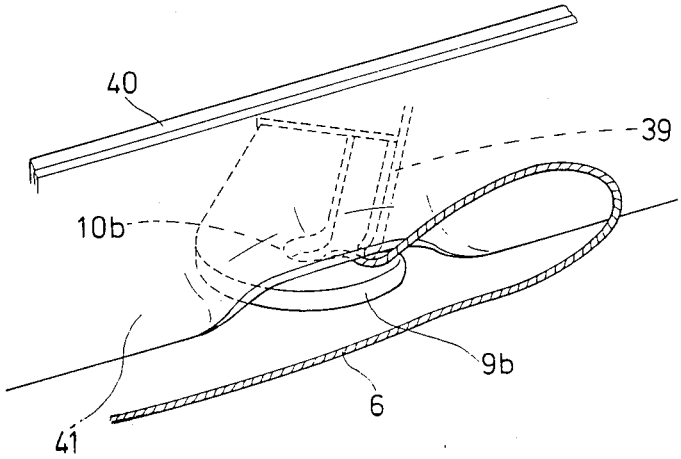
Figure 26:
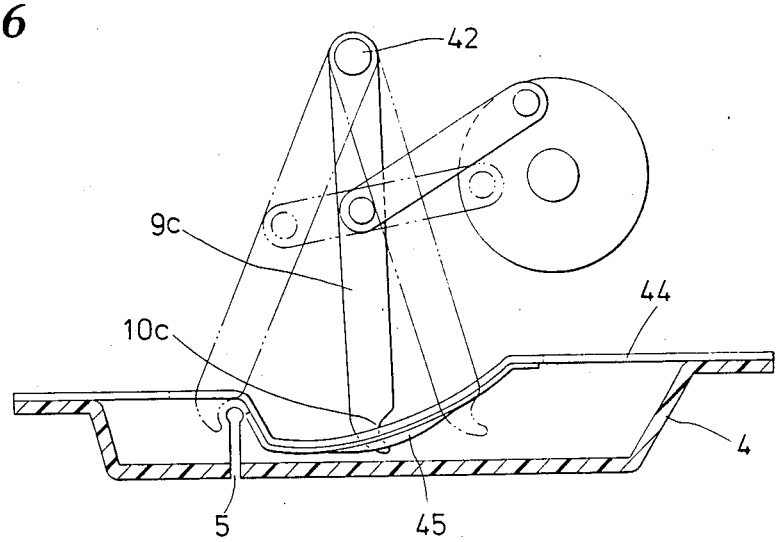
Figure 27:
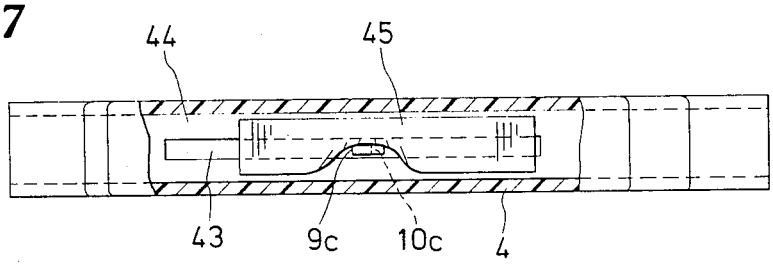
Figure 28:
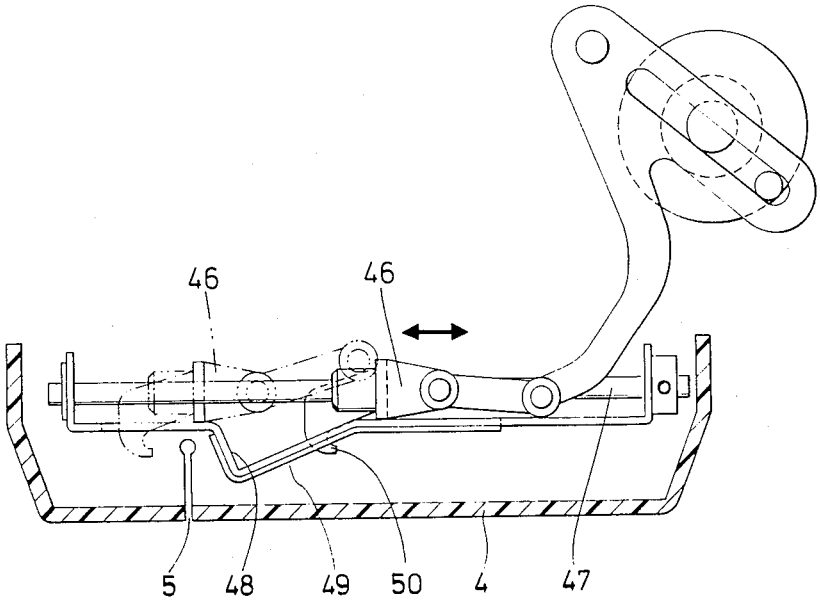

FIGS. 19 and 20 are perspective views diagrammatically illustrating the operation of the thread take-up lever 9 acting on a cover 34 shown in FIG. 17;

FIG. 21 is a top view of a sewing machine having still another embodiment of the invention, the thread guide member 4 being shown in section;

FIG. 22 is a sectional view taken along the line XXII—XXII in FIG. 21;

FIG. 23 is a top view showing the front end portion of a thread take-up lever 9*b* used in still another embodiment;

FIG. 24 is a top view for explaining the operation of the thread take-up lever 9*b* shown in FIG. 23 acting on a skirt member 41;

FIG. 25 is an enlarged perspective view showing the positional relationship between the thread take-up lever 9*b* and the skirt member 41;

FIG. 26 is a top view showing the principal portion of a sewing machine having still another embodiment of the invention;

FIG. 27 is a front view showing the positional relationship between a skirt member 45 and a thread take-up lever 9*c* shown in FIG. 26; and FIG. 28 is a top view showing the principal portion of a sewing machine having still another embodiment of the invention.

DESCRIPTION OF THE PREFERRED EMBODIMENTS

This invention is applicable to a thread take-up lever device having a thread take-up lever formed with an eyelet for receiving an upper thread, as in the most common sewing machine, but effective particularly when applied to a thread take-up lever device disclosed in copending applications (Argentine Patent Application No. 303,859, Australian Patent Application No. 56449/86, Brazilian Patent Application No. 507,075, European Patent Application No. 86303340.3, Finnish Patent Application No. 86 1911, Korean Patent Application No. 86-3538, New Zealand Patent Application No. 215921, Norwegian Patent Application No. 861796, Portuguese Patent Application No. 82,525, South African Patent Application No. 86/3195, U.S. patent application No. 860,224), now U.S. Pat. No. 4,688,501, issued Aug. 25, 1987 "Upper Thread Guide Mechanism for Sewing Machines," previously filed by the present applicant (assignee). Herein, these applications are referred to as "prior applications." In the "prior application," there are installed a pair of thread guide means spaced a predetermined distance from each other to be disposed on opposite sides of the path of travel of a thread engaging portion formed on thread take-up lever means. The pair of thread guide means are respectively formed with through-passages to allow a thread to pass therethrough in a direction which is substantially orthogonal to said path. While being reciprocated across the space between the pair of thread guide means, the engaging portion of the thread take-up lever means engages the portion of the thread located between the pair of thread guide means and draws said thread portion during its forward travel and stops drawing the thread in its return travel.

Figure 1:
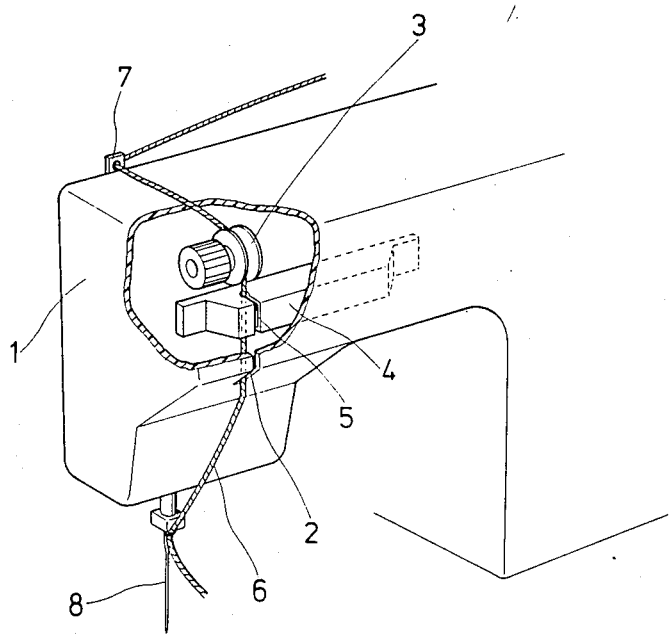

In FIG. 1, a portion of a sewing machine having the technique disclosed in said "prior applications" applied thereto is shown in perspective view. In FIG. 1, the upper wall and front wall of the arm head 1 of a sewing machine frame are formed with a slit 2, a portion of which is shown, extending in a vertical plane. As shown by breaking away a portion of the wall of the arm head 1, a tension regulator device 3 and a thread guide member 4 are disposed within the arm head 1 in positional association with the slit 2. The thread guide member 4 itself forms said "pair of thread guide means," and said "through-passage" is realized by a single groove 5 continuously extending over the upper wall, front wall and lower wall of the thread guide member 4. An upper thread 6 fed from a thread supply source, such as a bobbin (not shown), is engaged by a thread guide element 7 and inserted in the slit 2, and then it is passed through the eyelet of a needle 8. When the thread 6 is inserted in the slit 2, it is held between a pair of tension disks provided in the tension regulator device 3 while it is received in the groove 5 of the thread guide member 4.

The thread guide member 4 has a horizontally extending opening in its back side, and the front end of a thread take-up lever (not shown in FIG. 1), i.e., its engaging portion adapted to engaged the thread 6 projects into said opening, said engaging portion being horizontally reciprocated within said thread guide member 4.

Figure 2:
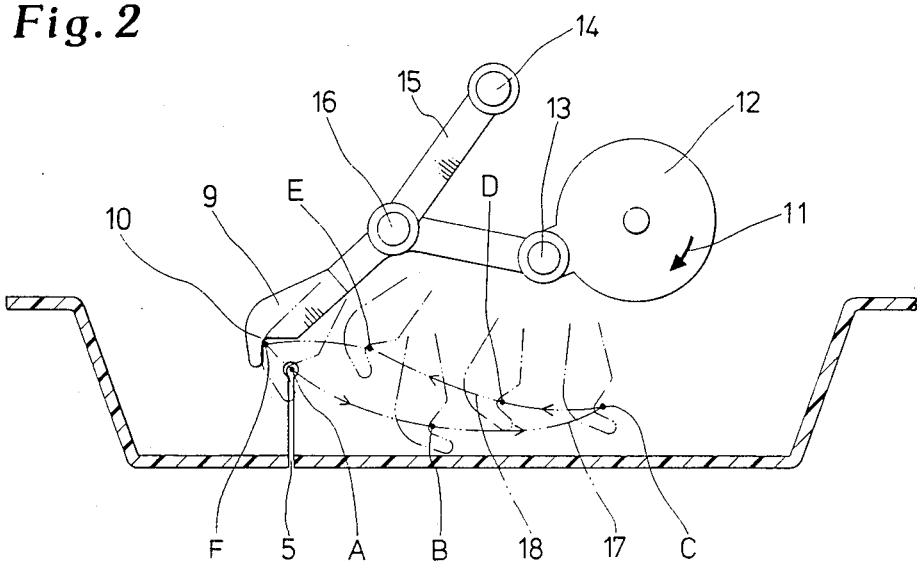

In FIG. 2, an example of a thread take-up lever such as the one described above is shown in top view. The thread take-up lever 9 shown therein is substantially the same as the one shown in FIG. 13 in the "prior applications," having an engaging portion 10 in the form of a hook formed on the front end thereof. The engaging portion 10 is reciprocated in such a manner that the path of its forward travel differs from the path of its return travel. Operatively associated with the main shaft (not shown) housed in the sewing machine frame is a disk 12 rotated in the direction of arrow 11, said disk 12 having a pin 13 installed at an eccentric position thereon. The thread take-up lever 9, which is L-shaped, is pivotally connected at one end thereof to the pin 13. A connecting link 15 is pivotally supported at one end thereof on a pin 14 fixed to the frame. The other end of the connecting link 15 is pivotally connected to the bend of the thread take-up lever 9 by a pin 16. In such arrangement, when the disk 12 is rotated in the direction of arrow 11, the thread take-up lever 9 performs a kind of swing motion; when attention is paid to the path of travel of its engaging portion 10, it is seen that it moves along a forward path 17 during its forward travel and along a return path 18 during its return travel.

Figure 3A:
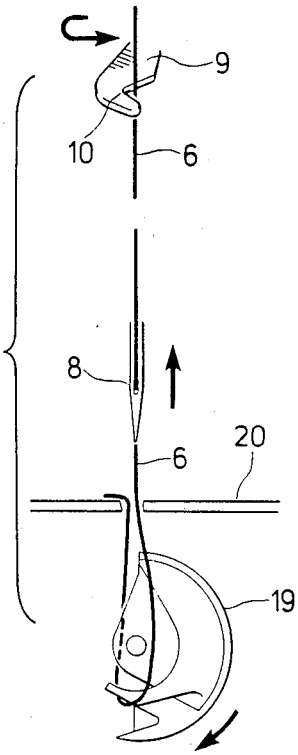

In FIG. 2, the position of the groove 5 is illustrated to clarify the positional relationship between the range of movement of the thread take-up lever 9 and the thread guide member 4 shown in FIG. 1. A plurality of typical positions to be taken by the thread take-up lever 9, particularly by its engaging portion 10 are shown at A, B, C, D, E, and F. FIGS. 3A through 3F illustrate the operating relationship among the engaging portion 10 of the thread take-up lever 9, the needle 8 and the shuttle hook 19. The suffixes A through F in FIGS. 3A through 3F correspond to A through F, respectively, shown in FIG. 2. Thus, for example, FIG. 3A shows the state in which the engaging portion 10 shown in FIG. 2 is positioned at A.

In FIG. 3A, the engaging portion 10 starting its forward travel engages the thread 6. The needle 8 is moving upward. The shuttle hook 19, arresting the thread 6, is rotated forward to the limit angle while drawing the thread 6 downward.

Figure 3B:
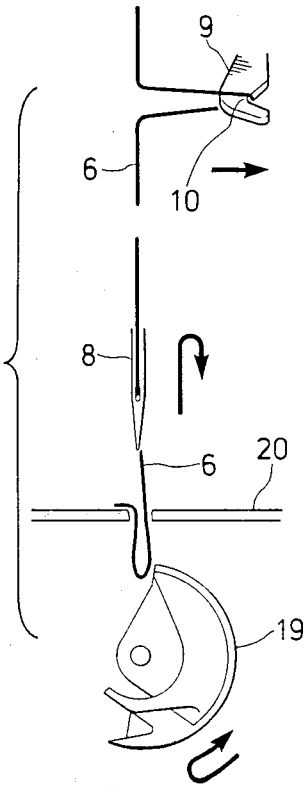

In FIG. 3B, the engaging portion 10 quickly draws the thread 6 to pull up the thread 6 disengaged from the shuttle hook 19. The needle 8 reaches the highest point and then starts to lower. The shuttle hook 19 is rotated backward as soon as it releases the thread 6.

Figure 3C:
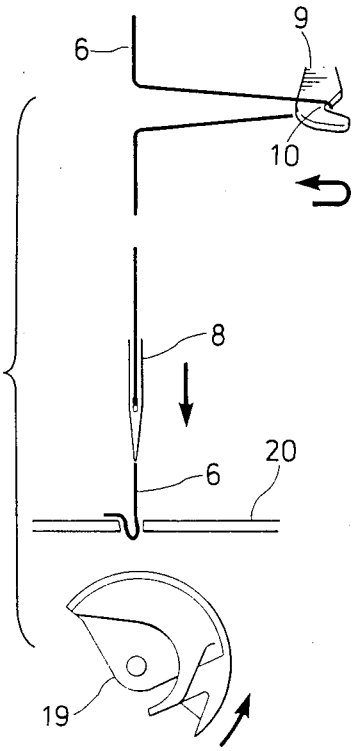

In FIG. 3C, the engaging portion 10 reaches the extreme right-hand side end in its forward travel to tighten the thread 6 to the fullest extent. The needle 8 is lowering. The shuttle hook 19 is on the way of its backward rotation in order to arrest the thread 6.

Figure 3D:
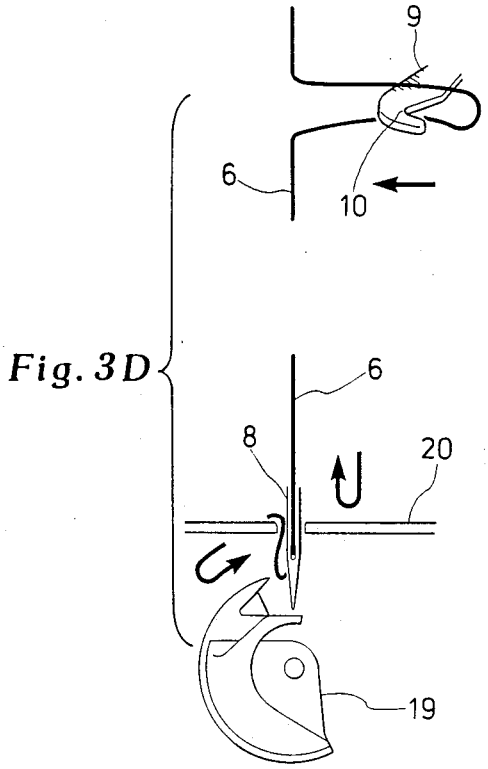

In FIG. 3D, the engaging portion 10 turns from forward to return travel, when the thread 6 is carried by the lowering needle 8 withdrawn toward the shuttle hook 19. Therefore, the speed of the engaging portion 10 in its return travel substantially corresponds to the speed at which the thread 6 is pulled downward by the needle 8. The needle 8 reaches the lowest point and then starts to rise. At this time, the thread slacks and then forms a loop to be arrested by the shuttle hook 19. The shuttle hook 19 starts its forward rotation, trying to arrest said loop of the thread 6.

Figure 3E:
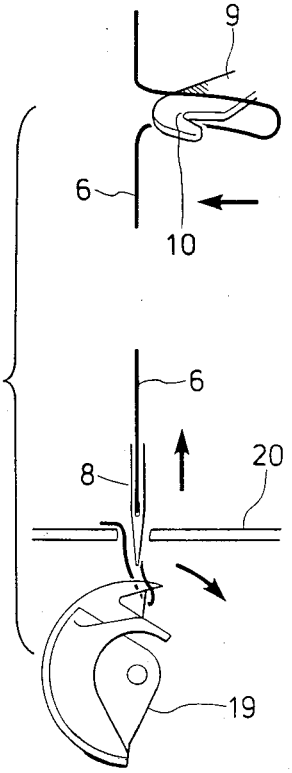

In FIG. 3E, the engaging portion 10 makes its return travel at a faster speed than the speed at which the thread 6 is pulled downward. As a result, the thread 6 is left behind by the thread take-up lever 9 while slacking in the vicinity of the engaging portion 10. The needle 8 is in the state of being extracted from a fabric 20. Before the needle 8 is extracted from the fabric 20, the shuttle hook 19 arrests the loop of the thread 6.

Figure 3F:
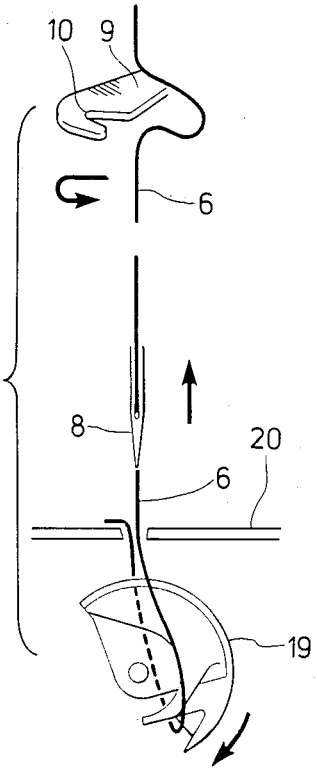

In FIG. 3F, the engaging portion 10 completes its return travel and turns to its forward travel. The needle 8 further rises. The shuttle hook 19 pulls the thread 6 downward as it is rotated.

Thereafter, the state of FIG. 3A is restored, such operation being repeated henceforth.

The operation described above refers to the normal operation, but if a thread break takes place, the thread 6 clings to the thread take-up lever 9 and in the worst case it coils itself around the thread take-up lever 9. Such phenomenon is noticeable particularly where there are wall surfaces which define, from above and below, the region in which the engaging portion 10 is horizontally reciprocated, as in the case where the thread guide member 4 shown in FIG. 1 is provided. FIGS. 4 through 8 illustrate the phenomenon of the thread 6 coiling itself around the thread take-up lever 9.

Figure 4:
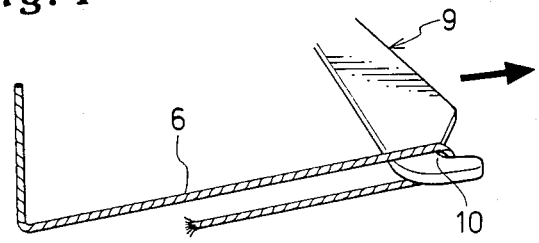
Figure 5:
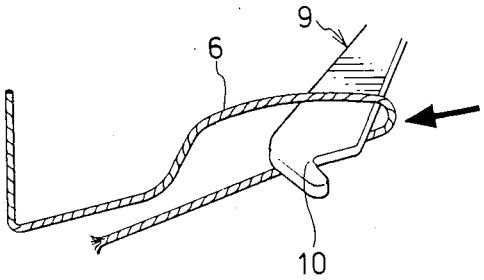
Figure 6:
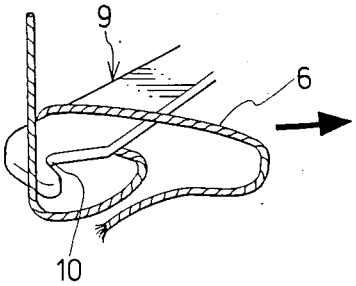
Figure 7:
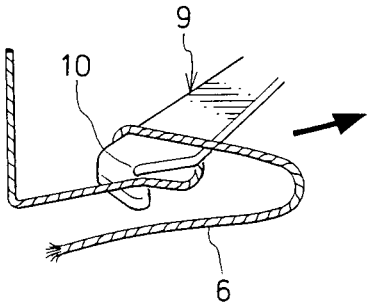
Figure 8:
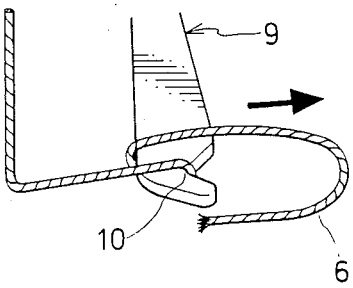

If a thread break takes place, as shown in FIG. 4, when the thread take-up lever 9 draws the thread 6, then a slack forms in the thread 6, as shown in FIG. 5, during the return travel of the thread take-up lever 9. As shown in FIG. 6, when the thread take-up lever 9 has completed its return travel, the thread 6 clings to the thread take-up lever 9. In this state, as shown in FIG. 7, when the thread take-up lever 9 makes its forward travel, the engaging portion 10 of the thread take-up lever 9 arrests the thread 6 again, and as the thread take-up lever 9 continues its forward travel, the thread 6 coils itself around the thread take-up lever 9, as shown in FIG. 8.

Figure 9D:
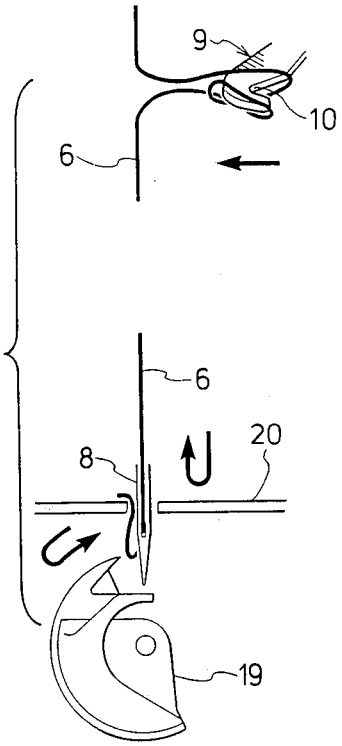
Figure 9E:
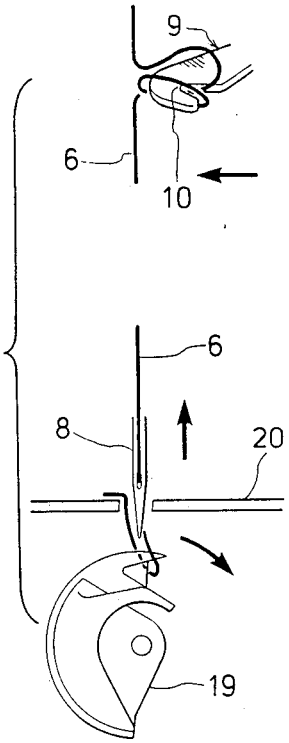

The above-described phenomenon of the thread 6 clinging to or coiling itself around the thread take-up lever 9 is not limited to the time when a thread break takes place. For example, if the thread 6 is fluffy or hard-twisted, it clings to the thread take-up lever 9 very often. FIGS. 9D and 9E shows operating steps corresponding to FIGS. 3D and 3E, respectively.

In FIG. 9D, the thread 6 released from being drawn by the thread take-up lever 9 forms a one-sided slack because it tends to cling to the thread take-up lever 9.

In FIG. 9E, the one-sided slack in the thread 6 causes the thread 6 to cling to the thread take-up lever 9 more considerably in accordance with the progress of return motion of the thread take-up lever 9. This phenomenon is followed by the phenomenon shown in FIGS. 6 through 8, with the thread 6 clinging complicatedly to the thread take-up lever 9.

Figure 10D:
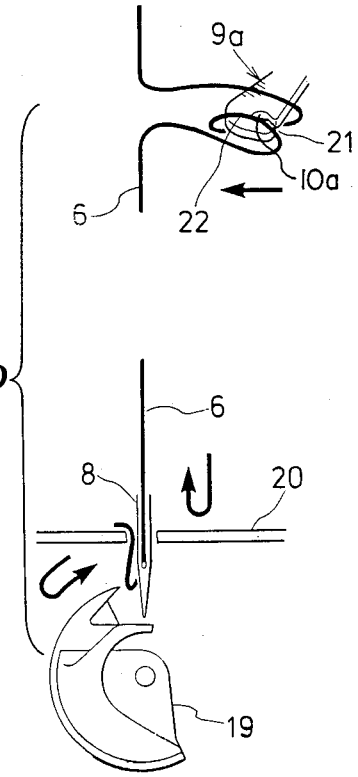
Figure 10E:
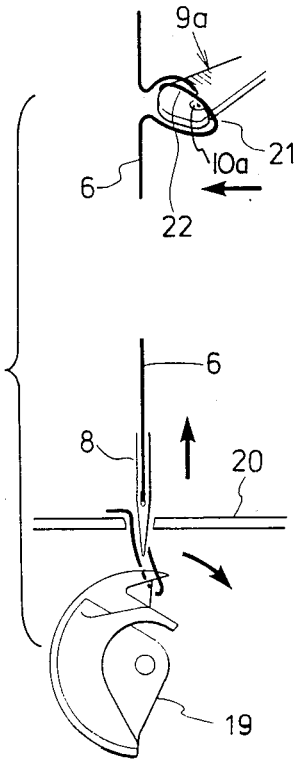

The clinging of the thread 6 to the thread take-up lever 9 described with reference to FIGS. 4 through 8, and 9D and 9E also takes place in such case as a thread take-up lever having an eyelet which thread take-up lever makes its return travel while bringing the thread with it. FIGS. 10D and 10E show the operation of a thread take-up lever 9*a* constructed to bring the thread 6 with it also when it makes its return travel, the states shown in these figures corresponding to those shown in FIGS. 3D and 3E, respectively.

The thread take-up lever 9*a* shown in FIGS. 10D and 10E is designed so that its engaging portion 10*a* receives the thread 6 from the side but that once it receives the thread it does not easily allow the thread 6 to escape therefrom even when its return travel takes place. That is, the front end of a hook which forms the engaging portion 10*a* is only formed with a clearance 21 which allows passage of the thread 6, the engaging portion 10*a* being closed except for the clearance 21.

In FIG. 10D, the thread 6 released from being drawn by the thread take-up lever 9*a* forms a slack. On the other hand, the thread 6 has a tendency to untwist, and the slack portion of the thread 6 has a tendency to deform in response to this untwisting. In FIG. 10D, the slack in the thread 6 having been formed below the thread take-up lever 9*a* is indicated at 22. The slack 22 deforms as a result of said untwisting and runs on to the thread take-up lever 9*a*.

In FIG. 10E, as a result of the shuttle hook 19 arresting the thread 6, the latter causes its slack 22 to firmly clinging to the thread take-up lever 9*a*.

In addition, it is to be pointed out that the states of the thread 6 clinging to the thread take-up lever 9 or 9*a* shown in FIGS. 4 through 8, FIGS. 9D and 9E, and FIGS. 10D and 10E are shown by way of example only.

The phenomenon of the thread 6 clinging to or coiling itself around the thread take-up lever 9 or 9*a*, described above, makes troublesome the repair for restoration of the normal operating condition. Further, in the case where a phenomenon of clinging takes place without being caused by a thread break, desired stitches cannot be formed and skipped stitches often result. Thus, at any rate, it is necessary to prevent such clinging of the thread 6 to the thread take-up lever 9 or 9*a*. Various examples of thread take-up devices provided with such cling-preventive means will now be described with reference to FIGS. 11 and others.

Figure 11:
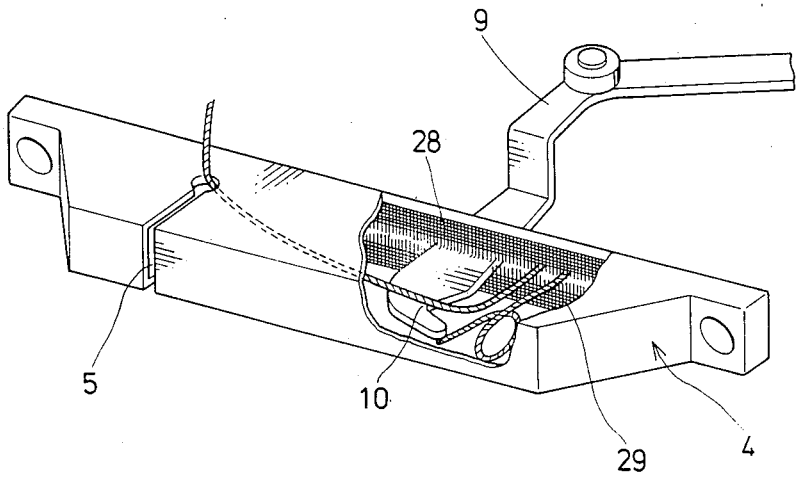
FIG. 11 is an enlarged perspective view showing the positional relationship between a thread guide member 4 shown in FIG. 1 and the thread take-up lever 9 shown in FIG. 2.
Figure 12:
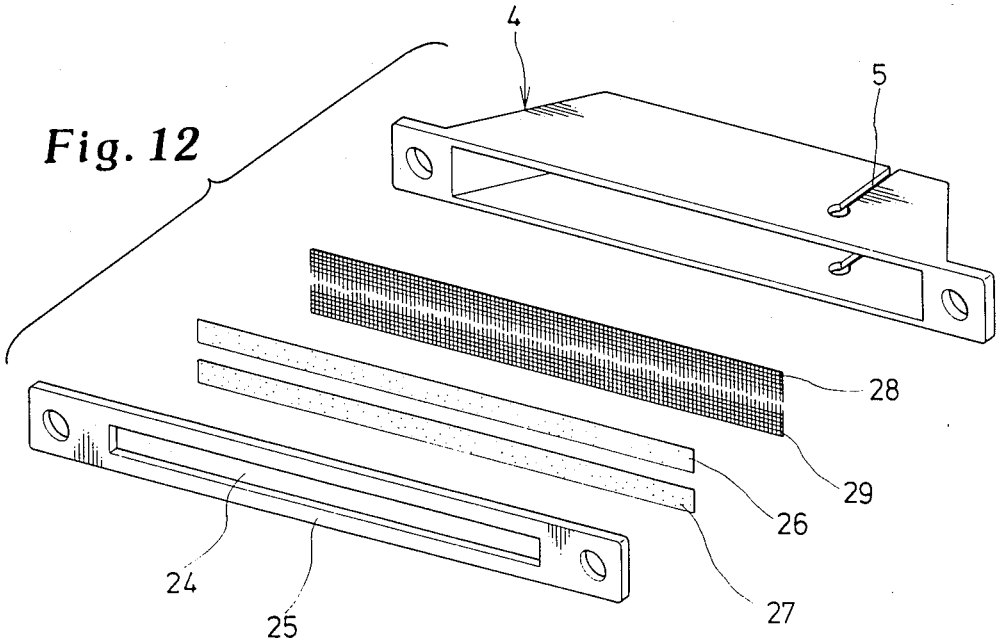
FIG. 12 is an exploded perspective view showing the arrangement associated with the thread guide member 4 of FIG. 11.

FIG. 11 is an enlarged perspective view showing the positional relationship between a thread guide member 4 and a thread take-up lever 9. In FIG. 12, the arrangement of the thread guide member 4 is shown in exploded perspective view.

The back of the thread guide member 4, as shown in FIG. 12, has attached thereto a cover 25 having a horizontally extending slot 24. On the inner side of the cover 25, ribbons 28 and 29 are applied to the upper and lower sides of the slot 24 through two-sided adhesive tapes 26 and 27. The ribbons 28 and 29 are positioned such that the lower edge of the ribbon 28 contacts the upper edge of the ribbons 29, or positioned with a slight clearance defined therebetween. The ribbons 28 and 29 are formed, for example, of a fabric, some horizontally extending threads of said ribbons being extracted adjacent their opposed edges to impart a greater frictional resistance to the thread 6.

The thread take-up lever 9 arrests the thread 6 by its engaging portion 10 to draw it in V-form during its forward travel, but during its return travel it releases the thread 6. The engaging portion 10, as shown in FIG. 11, projects out from between the ribbons 28 and 29 and is reciprocated within the thread guide member 4. Therefore, the thread 6 released from the thread take-up lever 9 is lightly held by one or both of the upper and lower ribbons 28 and 29, while the thread take-up lever 9 makes its return travel, wedging through between the ribbons 28 and 29. The thread 6 held by the ribbon 28 and/or the ribbon 29 is pulled downward as the shuttle hook 19 shown in FIGS. 3E through 3F is rotated.

In the embodiment described above, the ribbons 28 and 29 each have a tuft formed by extracting some horizontally extending threads from a fabric; however, they may be replaced by a fabric having fluff or piles, a brush, a non-woven fabric or leather.

Figure 13:
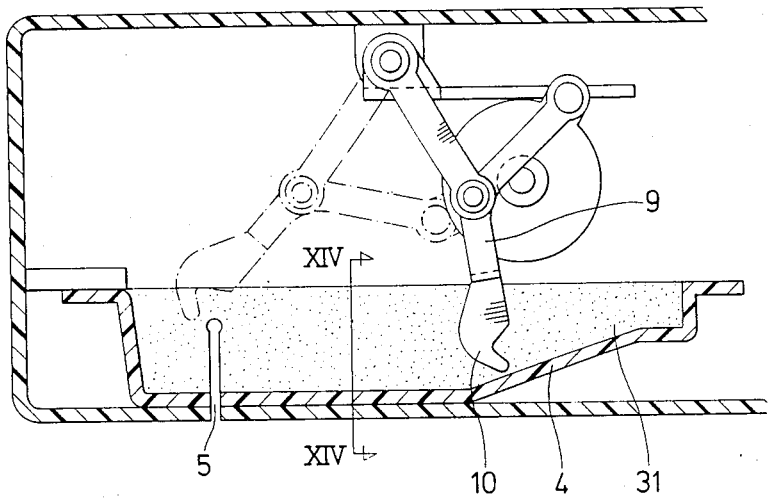
FIG. 13 is a top view showing the principal portion of a sewing machine having another embodiment of the invention, the thread guide member 4 being shown in section.
Figure 14:
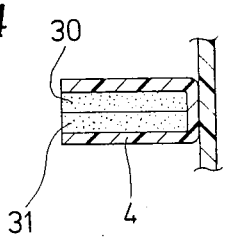
FIG. 14 is a sectional view taken along the line XIV—XIV in FIG. 13.

In an embodiment shown in FIGS. 13 and 14, two superposed sponge members 30 and 31 are fitted in a thread guide member 4. A thread take-up lever 9 is reciprocated between sponge members 30 and 31. The sponge members 30 and 31, like the ribbons 28 and 29 described above, function as thread holding means.

Figure 16:
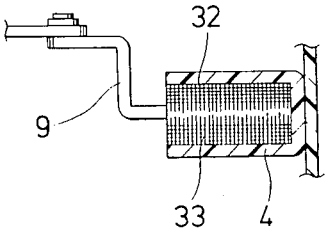
FIG. 16 is a sectional view taken along the line XVI—XVI in FIG. 15.
Figure 15:
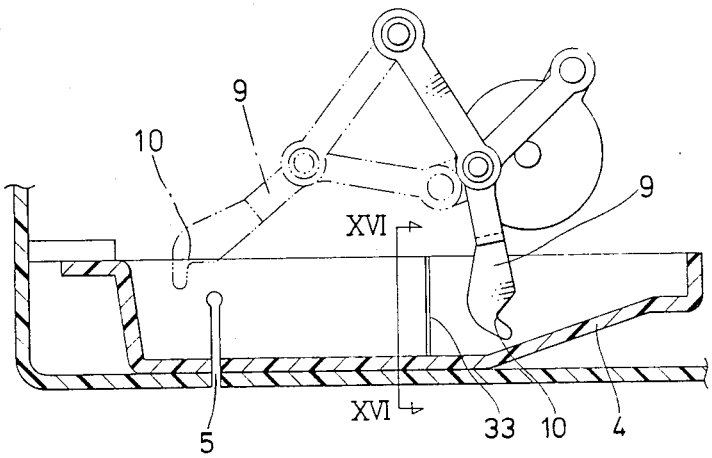
FIG. 15 is a top view of the principal portion of a sewing machine having still another embodiment of the invention, the thread guide member 4 being shown in section.

In an embodiment shown in FIGS. 15 and 16, there are vertically opposed ribbons 32 and 33 which extend to intersect the path of travel of the engaging portion 10 of a thread take-up lever 9 within a thread guide member 4. The ribbons 32 and 33 may be formed of the same material as that of the ribbons 28 and 29 shown in FIGS. 11 and 12 described above. According to this embodiment, the engaging portion 10 passes between the ribbons 32 and 33 at one place only during both of the forward and return travels of the thread take-up lever 9. Preferably, the ribbons 32 and 33 are positioned adjacent the initial end of return travel of the engaging portion 10.

In an embodiment shown in FIGS. 17 through 20, a cover 34 is attached to a thread guide member 4 with the main portion thereof positioned within the thread guide member 4. The cover 34 is formed with a slot 35 which receives the engaging portion 10 of a thread take-up lever 9 to allow the reciprocating motion of said engaging portion 10. A skirt member 36 is attached at its upper edge to cover 34. The skirt member 36 extends over the slot 35. The skirt member 36 is formed of a flexible sheet material such as a fabric, resin sheet, leather or the like.

In the case of the embodiment described above, the thread take-up lever 9 arrests the vertically extending thread 6, inserted in the groove 5, by its engaging portion 10 during its forward travel, and as shown in FIG. 19, it draws the thread 6 as it moves, with the engaging portion 10 projecting out through the skirt member 36. In the return travel of the thread take-up lever 9, as shown in FIG. 20, as the engaging portion 10 retracts from its state of projecting out through the skirt member 36, the thread 6 is separated from the thread take-up lever 9 by the skirt member 36. In the embodiment shown in FIGS. 17 through 20, as described above, the skirt member 36 functions as thread braking means which acts in the direction in which while engaging a portion of the thread 6 engaged by the engaging portion 10 it releases a slack in the thread 6, which forms during the return travel of the engaging portion 10, from the thread take-up lever 9 as a result of the return travel of the thread take-up lever 9. Such thread braking means has only to be positioned so that it extends across the path of travel of the engaging portion 10.

In an embodiment shown in FIGS. 21 and 22, adjacent the initial end of return travel of an engaging portion 10 in a thread guide member 4, sponge members 37 and 38 are installed to be opposite to a thread take-up lever 9 from above and below. The position of the sponge members 37 and 38 is such that in the initial stage of return travel of the thread take-up lever 9, its engaging portion 10 projects out from between the sponge members 37 and 38.

In the case of the above embodiment, the thread (not shown) released from the thread take-up lever 9 is lightly held between the sponge members 37 and 38 or separated from the thread take-up lever 9 as the engaging portion 10 is retracted into and between the sponge members 37 and 38. That is, the sponge members 37 and 38 act as thread holding means imparting a frictional resistance to the thread and also as thread braking means which acts in the direction in which it separates a slack, which forms in the thread during the return travel of the engaging portion 10, from the thread take-up lever 9.

In the embodiment shown in FIGS. 21 and 22, the sponge members 37 and 38 may be replaced by rigid members positioned to contact the thread take-up lever 9 with slight frictional resistance or positioned with a slight clearance with respect to the thread take-up lever 9.

An embodiment shown in FIGS. 23 through 25 is characterized by the construction of the engaging portion of a thread take-up lever. That is, as shown in FIG. 23, the engaging portion 10*b* of the thread take-up lever 9*b* is closed by a plate spring 39 which can be deformed by a relatively light force. Therefore, the thread engaging the engaging portion 10*b* can be received in the engaging portion 10 by deforming the plate spring 39, but once the thread is received in the engaging portion 10*b*, it cannot easily escape therefrom. Therefore, it follows that the thread take-up lever 9*b* shown in FIG. 23, like the one thread take-up lever 9*a* shown in FIG. 10D, brings the thread with it also in its return travel.

As shown in FIGS. 24 and 25, in connection with the thread guide member 4, a cover 40 of substantially the same construction as that of the cover 34 shown in FIG. 17 is installed and a skirt member 41 is installed in substantially the same manner as in the skirt member 36.

In the embodiment described above, the skirt member 41 acts in such a manner as to pull the thread 6 from the engaging portion 10*b* to straighten the slack in the thread 6 so that the latter is more or less tensioned. Therefore, the phenomenon of the thread 6 clinging to the thread take-up lever 9*b* caused as by the untwisting of the thread 6 is advantageously prevented.

In an embodiment shown in FIGS. 26 and 27, a thread take-up lever 9*c* is turned around the axis of a fixed pin 42, so that its engaging portion 10*c* is moved along the same arcuate path both in its forward and return travels. In this embodiment, a cover 44 having a slot 43 is installed in connection with a thread guide member 4. The cover 44 has a skirt member 45 attached thereto in substantially the same manner as in the skirt member 36 shown in FIG. 19. According to this embodiment, in each of the forward and return travels of the thread take-up lever 9*c*, the engaging portion 10*c* passes through below the skirt member 45.

In an embodiment shown in FIG. 28, thread take-up lever means 46 is linearly reciprocated as it is guided by a straight rod 47. A cover 48 installed in connection with a thread guide member 4 has a slot which is substantially the same as that of the cover 34 shown in FIG. 19. A skirt member 49 is installed in substantially the same manner as in the skirt portion shown in FIG. 19.

In the embodiment described above, when the thread take-up means 46 is reciprocated, its engaging portion 50 passes through below the skirt member 49 both in its forward and return travels.

The cling-preventive means shown in various forms described so far prevents the thread not only from clinging to the thread but also from entering the mechanism which drives the thread take-up means; thus, it prevents the thread from being entangled in such mechanism or from being broken as a result of such entanglement.

Although the present invention has been described and illustrated in detail, it is clearly understood that the same is by way of illustration and example only and is not to be taken by way of limitation, the scope of the present invention being limited only by the terms of the appended claims.

What is claimed is:

1. A thread take-up lever device for sewing machines, comprising thread take-up means (9, 9*c*) having a portion (10, 10*c*) adapted to engage a thread (6), said thread take-up means being reciprocated in such a manner that said engaging portion is reciprocated along a predetermined path and draws the thread during its forward travel; wherein said thread take-up lever means is adapted to release the thread from said engaging portion during its return travel and acts to put away the thread from said engaging portion during the return travel of said thread take-up lever means;

means (36, 41, 45, 49) for preventing the thread from clinging to said thread take-up lever means, fixedly installed in at least one position along said path of travel of said engaging portion and adapted to contact a portion of the thread to thereby prevent said portion from being brought by said thread take-up lever means during the return travel of said thread take-up lever means; said cling-preventive means comprising thread braking means (36, 41, 45, 49) extending to intersect the path of travel of said engaging portion, wherein said thread braking means acts in the direction in which while engaging a portion of the thread engaged by said engaging portion it separates a slack, which forms in the thread during the return travel of said engaging portion, from said thread take-up lever means as a result of the return travel of said thread take-up lever means; and said thread braking means comprises a skirt member (36, 41, 45, 49) of flexible sheet material which extends in the direction to project into the plane in which said thread take-up lever means is reciprocated, at least the front edge of said skirt member contacting said thread take-up lever means.

2. A thread take-up lever device as set forth in claim 1, wherein the direction of reciprocating motion of said engaging portion of said thread take-up lever means is substantially horizontal.

3. A thread take-up lever device as set forth in claim 1, further including a pair of thread guide means (4) disposed on both sides of said path of travel along which said engaging portion of said thread take-up lever means is reciprocated, said pair of thread guide means defining a through-passage allowing the thread to pass therethrough in a direction which is substantially orthogonal to said path, and wherein while being reciprocated across the space between said pair of guide means, said engaging portion of said thread take-up lever means engages the portion of the thread located between said pair of thread guide means and draws said thread portion during its forward travel and stops drawing the thread in its return travel.

4. A thread take-up lever device for sewing machines, comprising thread take-up means (9, 9*c*) having a portion (10, 10*c*) adapted to engage a thread (6), said thread take-up means being reciprocated in such a manner that said engaging portion is reciprocated along a predetermined path and draws the thread during its forward travel;

means (36, 41, 45, 49) for preventing the thread from clinging to said thread take-up lever means, fixedly installed in at least one position along said path of travel of said engaging portion and adapted to contact a portion of the thread to thereby prevent said portion from being brought by said thread take-up lever means; said cling-preventive means comprising thread braking means (36, 41, 45, 49) extending to intersect the path of travel of said engaging portion, wherein said thread braking means acts in the direction in which while engaging a portion of the thread engaged by said engaging portion it separates a slack, which forms in the thread during the return travel of said engaging portion, from said thread take-up lever means as a result of the return travel of said thread take-up lever means; said thread braking means comprising a skirt member (36, 41, 45, 49) of flexible sheet material which extends in the direction to project into the plane in which said thread take-up lever means is reciprocated, at least the front edge of said skirt member contacting said thread take-up lever means; and a pair of thread guide means (4) disposed on both sides of said path of travel along which said engaging portion of said thread take-up lever means is reciprocated, said pair of thread guide means defining a through-passage allowing the thread to pass therethrough in a direction which is substantially orthogonal to said path, sand wherein while being reciprocated across the space between said pair of guide means, said engaging portion of said thread take-up lever means engages the portion of the thread located between said pair of thread guide means and draws said thread portion during its forward travel and stops drawing the thread in its return travel.

5. A thread take-up lever device as set forth in claim 4, wherein said thread take-up lever means (9, 9*c*) is adapted to release the thread from said engaging portion (10, 10*c*, 50) during its return travel, and acts to put away the thread from said engaging portion during said return travel of said thread take-up lever means.

6. The thread take-up lever device as set forth in claim 4, wherein the direction of reciprocating motion of said engaging portion of said thread take-up lever means is substantially horizontal.

* * * * *